United States Patent [19]

Reed et al.

[11] Patent Number: 4,920,897

[45] Date of Patent: May 1, 1990

[54] BEACH AND LAWN TABLE WITH UMBRELLA HOLDER

[75] Inventors: Ross Reed; Charles Reed; Carl H. Gran, all of Naples, Fla.

[73] Assignee: Lil Twister Inc., Naples, Fla.

[21] Appl. No.: 344,654

[22] Filed: Apr. 28, 1989

[51] Int. Cl.[5] ..... A47B 13/02

[52] U.S. Cl. ..... 108/150; 248/156

[58] Field of Search ..... 108/150, 157, 95, 92, 108/159; 248/158, 156, 161, 530, 533, 545, 159, 127; 175/320

[56] References Cited

U.S. PATENT DOCUMENTS

| | | | |
|---|---|---|---|
| 2,162,636 | 6/1939 | Peoples | 248/156 X |
| 2,190,222 | 2/1940 | Strasser | 248/156 X |
| 2,628,297 | 2/1953 | Campomar | 248/156 X |
| 2,720,249 | 10/1955 | Peterson | 108/150 X |
| 3,317,168 | 5/1967 | Ziph | 248/156 |
| 3,368,858 | 2/1968 | Motter et al. | 108/150 X |
| 3,554,306 | 1/1971 | Wilburn | 175/320 |
| 3,828,373 | 8/1974 | Fraley | 248/156 X |
| 4,189,013 | 2/1980 | Adams et al. | 175/320 |

FOREIGN PATENT DOCUMENTS

| | | | |
|---|---|---|---|
| 266852 | 6/1925 | Fed. Rep. of Germany | 108/150 |

*Primary Examiner*—Jose V. Chen

*Attorney, Agent, or Firm*—Merrill N. Johnson

[57] ABSTRACT

A beach and lawn table which is affixed to the ground on which it rests by an auger projecting from the base of the table. The table has a single axially located leg which also provides a holder for the shaft of an umbrella. The table top is removably mounted on the upper end of the table's leg and also serves as a wrench to screw the auger into the ground until the base of the table rests firmly on the ground.

5 Claims, 2 Drawing Sheets

BEACH AND LAWN TABLE WITH UMBRELLA HOLDER

BACKGROUND AND SUMMARY OF THE INVENTION

Our invention relates to a table for outdoor use and particularly for use on beaches, in camping areas and on lawns where the surface of the ground is uneven and the table is subject to exposure to wind, rain and bright sun.

Outdoor leisure furniture used on beaches, in camping areas and on lawns beside swimming pools, patios and tennis courts is traditionally unstable in use due to the uneven surface and soft texture of the beach, ground or lawn on which the furniture rests, making the furniture likely to tip or blow over in even moderate breezes or storms.

Responding to the need for a table for use outdoors which will not rust or deteriorate due to continued exposure to bright sun, rain, wind and salt spray and which will be affixed to the ground on which it rests so that it will not tip or blow over due to winds and storms, we have invented a unique beach and lawn table which can easily and firmly be affixed to the ground on which the table rests. Moreover, our table is made almost entirely of thermoplastic material and thus is practically impervious to sun, wind, rain and salt spray, making our table ideally suited for outdoor use.

In addition, our table serves as a holder for an umbrella shielding the table from the sun or the holder for a flag, pennant, tiki torch or other accessory.

Simply put, our beach and lawn table is made mainly of injection molded plastic components except for a helical auger made of steel attached to the base of the table. In the interest of economy, the table consists of four separate molded plastic parts, namely, a separate removable table top, a single hollow cylindrical leg, a table base, and a leg cap.

The base is permanently mounted on the lower end of the cylindrical leg of the table by an epoxy glue or other bonding means. Similarly the leg cap is bonded onto the upper end of the table leg. The cap has a cubical extension or lug on its upper face with a cylindrical hole in the upper horizontal face of the cubical extension.

The cubical extension serves two purposes. First, the cylindrical axial hole permits the vertical shaft of an umbrella to be inserted into and held by the cap and leg as a holder for the umbrella or other accessory positioned above the table top.

Secondly, the cubical extension is designed to receive the removable table top and lock the table top into fixed position about the table leg as the table top is used as a wrench to twist the table's auger into the ground as hereinafter more fully described.

In addition to the four plastic components just described, the table also includes a finger-operable set screw mounted on the side of the table's leg to lock the shaft of the umbrella or other accessory into place within the table leg.

The table also includes a helical auger preferably made of cadmium coated steel and having at its lower end a rather sharp point. The upper end of the shaft is welded to a circular steel plate and the steel plate is securely fastened to the underside of the table base with pop rivets or other appropriate fastening means.

When a suitable location for the table has been found, the table top is placed over the cubical lug of the leg cap and the sharpened tip of the auger pushed vertically in to the ground, beach or lawn. Then, using the table top as a wrench, the auger is screwed into the ground until the underside of the table's base is firmly pressed into the surface of the ground. The combination of the resistance of the auger to any movement of the table and the resistance of the ground beneath the table base to any lateral movement of the table provides remarkable stability to the table despite physical blows, strong winds or storms.

BRIEF DESCRIPTION OF THE DRAWINGS

The attached drawings illustrate the essential features of a preferred embodiment of our invention in which.

DETAILED DESCRIPTION OF THE PREFERRED EMBODIMENT

Figure 1:
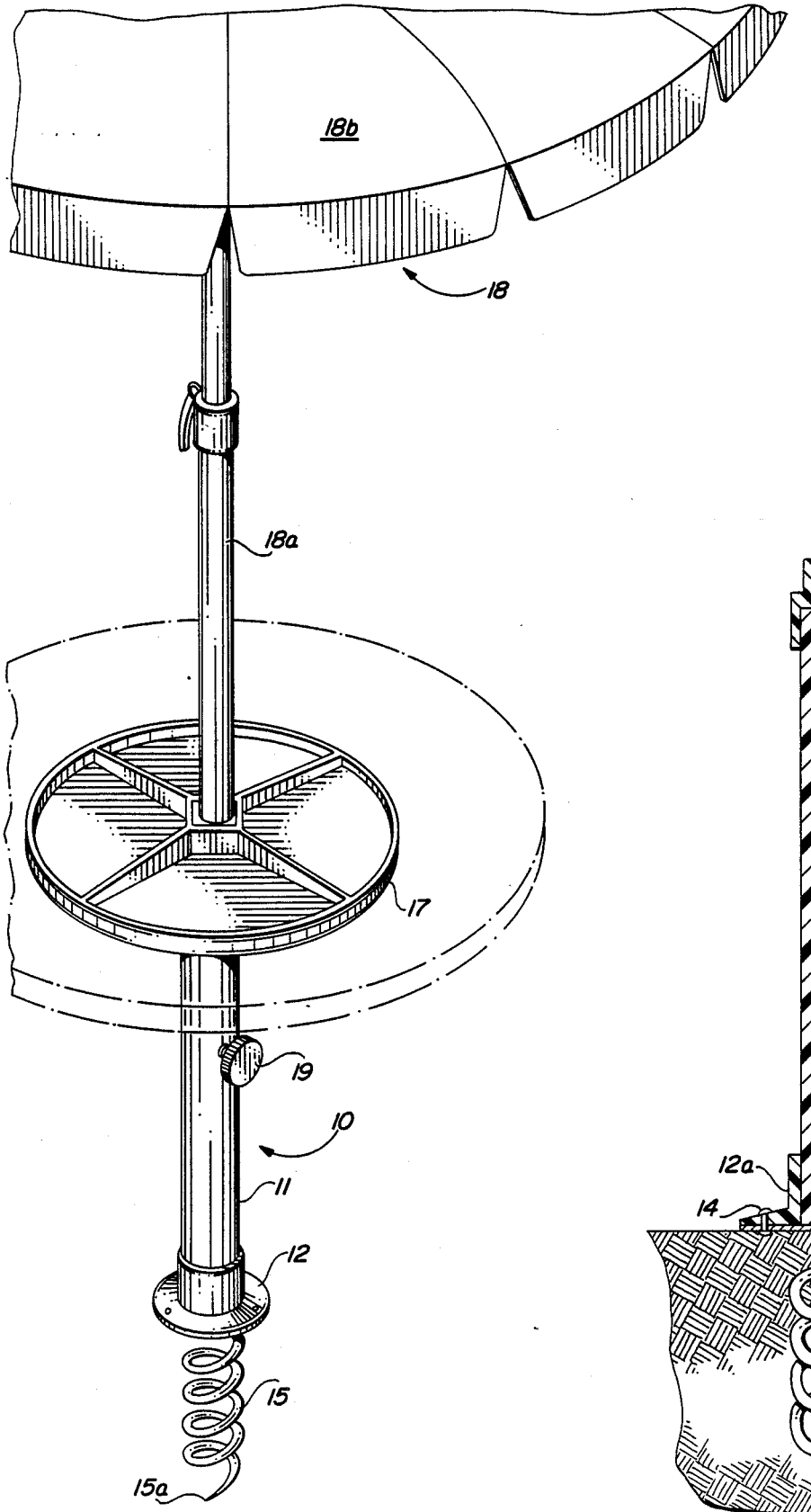
FIG. 1 a perspective view partially broken away showing my beach and lawn table holding a beach umbrella. The umbrella as such forms no part of my invention.

FIG. 1 of the drawings illustrates a preferred embodiment of our beach and lawn table 10 holding an umbrella 18 which forms no part of our invention.

Figure 2:
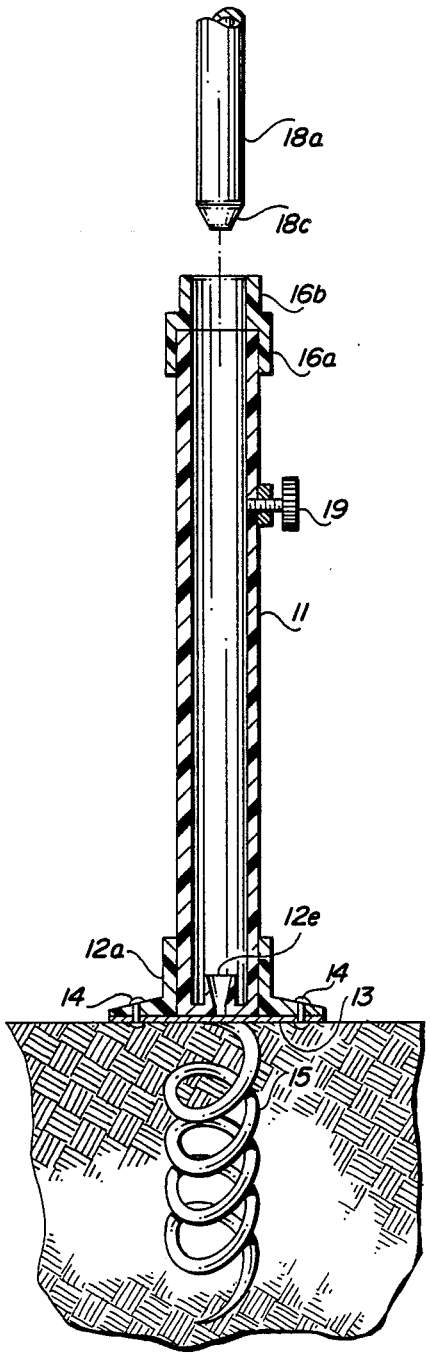
FIG. 2 a detailed view illustrating how the beach and lawn table shown in FIG. 1 is affixed to the ground on which it rests.

Table 10 includes a single hollow cylindrical table leg 11, a flanged table base 12, a leg cap 16 and a circular table top 17, all made of similar thermoplastic material. The table base 12 is permanently bonded to the lower end of leg 11 and the leg cap 16 is likewise permanently bonded to the upper end of leg 11 as best shown in FIG. 2.

Figure 3:
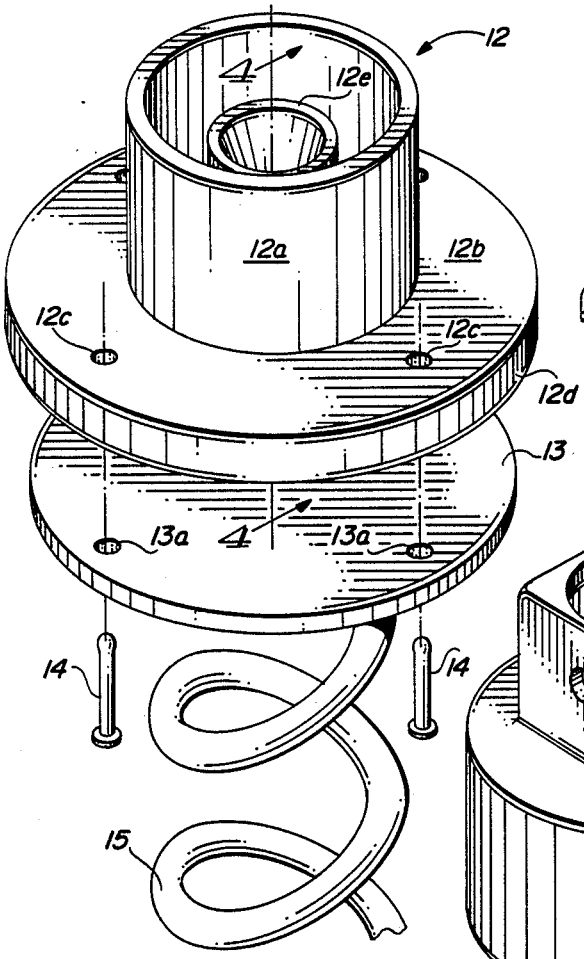
FIG. 3 exploded view showing the assembly of the auger the base of the table shown in FIG. 1.
Figure 4:
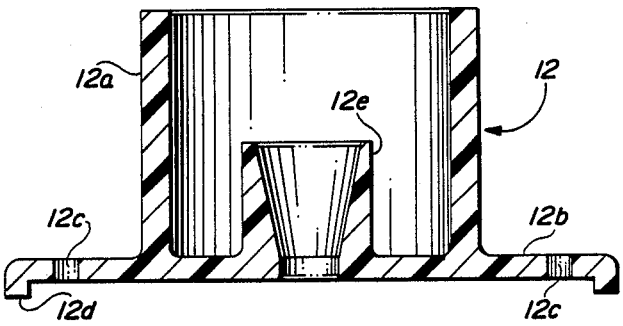
FIG. 4 a cross-sectional side view of the base of the table in FIG. 3.

The table base shown in FIGS. 3 and 4 includes a cylindrical upper portion **12*a*, a disc-shaped bottom portion 12*b* which contains a plurality of vertical holes 12*c*, a downwardly projecting flange 12*d* and a cup-shaped axial extension 12*e* designed to receive the lower end 18*c* of umbrella shaft 18*a*** or similar accessory.

Auger 15 consists of at least three helical turns of steel rod with a sharpened lower end **15*a* and cadminum plated to resist rusting. The upper end of auger 15 is securely welded to the underside of circular plate 13 made of galvanized steel. Plate 13 contains a plurality of circular holes 13*a* positioned to align with holes 12*a* in table base 12. The steel plate is sized to fit against the lower face of the table base surrounded by flange 12*d* and plate and base are joined together by pop rivets 14 as best shown in FIG. 3**.

Figure 5:
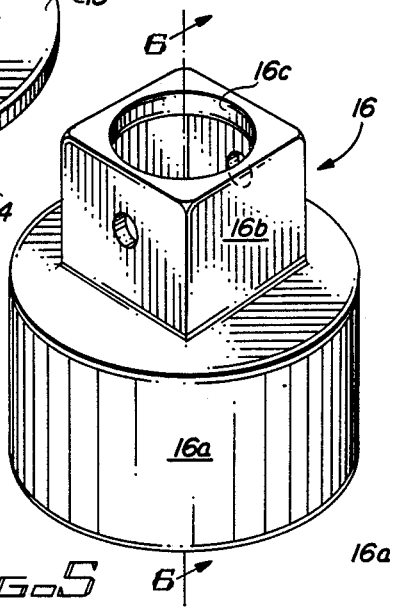
FIG. 5 perspective view of the leg cap of the table shown in FIG. 1 and 2.
Figure 6:
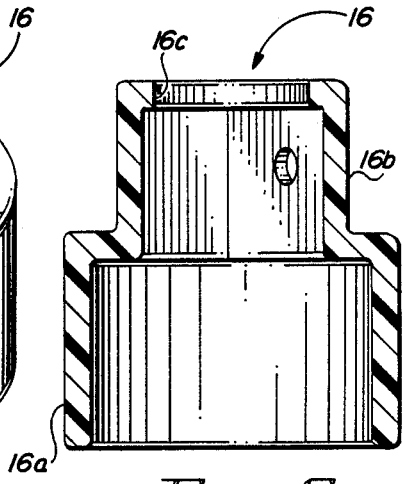
FIG. 6 is a cross-sectional side view of the leg cap shown in FIGS. 1, 2 and 5.

Leg cap 16 shown in FIGS. 5 and 6 includes a leg encircling downwardly projecting cylindrical cap portion **16*a*, a cubically shaped lug 16*b* extending upwardly from the upper face of cap portion 16*a*, and a cylindrical axially disposed hole 16*c* in the upper face of lug 16*b***.

Figure 7:
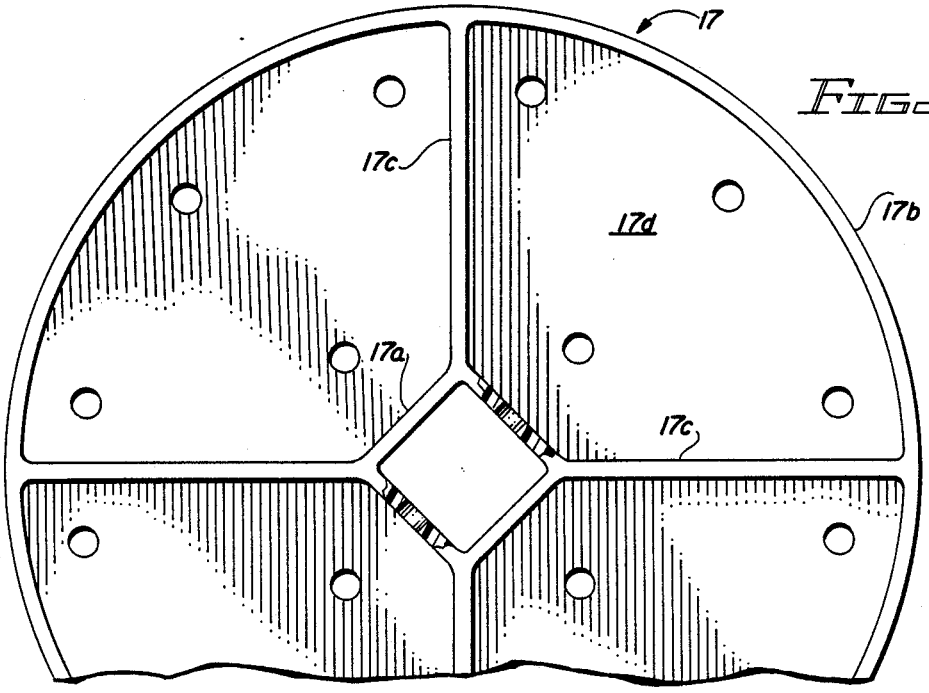
FIG. 7 a plan view taken from above and partially broken away of the table top shown in FIG. 1.

Table top 17 shown in FIGS. 1 and 7 includes a square axially disposed flange **17*a* sized to fit snugly over lug 16*b* of the leg cap, a table encircling upstanding circular edge 17***b*, four radially disposed upstanding flanges 17*c* and a flat horizontal circular face 17*d* which contains a plurality of unnumbered drain holes.

In order to secure the shaft 18*a* of umbrella 18 (or the shaft of any other accessory used with table 10) a finger-operable set screw 19 is threadedly set into the wall of table leg 11 as shown in FIGS. 1 and 2.

Other or alternate forms of table tops than table top 17 may be used with our beach and lawn table and a wider smooth topped alternate top is shown in dotted lines in FIG. 1. Other changes in design and arrangement of the components of our beach and lawn table will be apparent to those skilled in the art without departing from the spirit and scope of our invention. The illustration and description of the preferred embodiment herein by no means limits our invention whose scope is defined only in the appended claims.

We claim:

1. A beach and lawn table designed to be affixed to the ground on which it rests comprising:

a single upstanding hollow table leg.

a table base having a flat horizontal bottom face permanently attached to the lower end of the table leg, a leg cap permanently attached to the upper end of the table leg and having a cube-shaped lug extending upwardly and axially aligned with the table leg, a table top having a square hole at its center sized to fit snugly over and around the cube-shaped lug and supported by the leg cap, the table leg, the table base, the leg cap and the table top all made of a similar thermoplastic material, and, a vertically aligned helical auger attached to the bottom face of the table base and designed to be screwed into the ground by turning movement of the table top until the bottom face of the table base rests firmly on the ground.

2. A beach and lawn table as set forth in claim 1 which includes a cylindrical axially aligned hole in the lug sized to receive a shaft of an accessory which extends down into the hollow table leg.

3. A beach and lawn table as set forth in claim 2 wherein a finger-operable set screw threadedly mounted on the wall of the table leg is provided to secure a shaft of the accessory inserted into the hole in the lug.

4. A beach and lawn table designed to be affixed to the ground on which it rests comprising:

a single upstanding hollow cylindrical table leg, a table base having a flat horizontal bottom face permanently bonded to the lower end of the table leg, a leg cap permanently bonded to the upper end of the table leg and having a cube-shaped lug extending upwardly and axially aligned with the table leg with a cylindrical axially aligned hole in the lug sized to receive a shaft of an accessory which extends into the hollow table leg, the table leg, the table base, and the leg cap all made of similar thermoplastic material, a table top having a square hole at its center sized to fit snugly around the cube-shaped lug, and a vertically aligned helical auger attached to the bottom face of the table base and designed to be screwed into the ground by turning movement of the table top until the bottom face of the table base rests firmly on the ground.

5. A beach and lawn table as set forth in claim 4 wherein a finger-operable sert screw is threadedly mounted on the wall of the table leg to secure the shaft of the accessory inserted into the hole of the table lug.

* * * * *